United States Patent [19]

Falk

[11] 4,168,587

[45] Sep. 25, 1979

[54] APPARATUS FOR PROGRAMMED DISPLAY OF ADVERTISING MATTER SUCH AS PLACARDS, POSTERS OR THE LIKE

[75] Inventor: Svenåke Falk, Skanör, Sweden

[73] Assignee: Migronard A. B., Stockholm, Sweden

[21] Appl. No.: 804,605

[22] Filed: Jun. 8, 1977

[30] Foreign Application Priority Data

Jun. 8, 1976 [SE] Sweden ..... 7606415

[51] Int. Cl.[2] ..... G09F 11/06

[52] U.S. Cl. ..... 40/475; 40/505

[58] Field of Search ..... 40/475, 497, 500, 530, 40/574, 505

[56] References Cited

U.S. PATENT DOCUMENTS

| | | | |
|---|---|---|---|
| 1,002,588 | 9/1911 | King, Jr. | 40/475 |
| 1,530,179 | 3/1925 | Hoard | 40/574 |
| 1,914,597 | 6/1933 | Dobrowsky | 40/475 |
| 3,279,108 | 10/1966 | Cappellari | 40/475 |
| 3,394,674 | 7/1968 | Downing | 40/475 |
| 3,570,154 | 3/1971 | Cosenza | 40/475 |
| 3,585,746 | 6/1971 | Sterler | 40/475 |
| 3,643,359 | 2/1972 | Nowicki | 40/475 |
| 3,696,536 | 10/1972 | Reese et al. | 40/475 |
| 4,060,919 | 12/1977 | Sasaki | 40/497 |

*Primary Examiner*—Louis G. Mancene
*Assistant Examiner*—Paul J. Hirsch
*Attorney, Agent, or Firm*—Blair, Brown & Kreten

[57] ABSTRACT

An advertisement display pillar for door usage having a rectangular stand in which a plurality of units are mounted vertically and in parallel. Each unit has a plurality of frames comprising parts of a total poster display surface facing the viewer. The frames permit being turned like the leaves of a book according to desired programs. By so turning the frames several complete posters can be sequentially displayed.

9 Claims, 5 Drawing Figures

APPARATUS FOR PROGRAMMED DISPLAY OF ADVERTISING MATTER SUCH AS PLACARDS, POSTERS OR THE LIKE

BACKGROUND OF THE INVENTION

This invention relates to an apparatus for programmed display of advertising matter such as placards, posters and the like.

The apparatus belongs to the type usually called advertisement display pillar and which is relatively large and heavy. In a typical case the apparatus has the dimensions 3.5×2.5×0.7 for width, height and depth and has a weight of up to some metric tons. It is primarily intended for erection out of doors on some suitable foundation so that it is readily seen. In some cases it is even possible to mount such apparatuses on the outer walls of buildings, but these must then as a rule be prepared or reinforced for such mounting.

A known apparatus of the type indicated for programmed display of advertising matter and the like has several parallel plates which can be turned at fixed intervals through half a turn at a time in order to permit displaying two complete posters on its two sides.

A variant of said prior art apparatus comprises several parallel bars of triangular cross-section which are likewise rotatable at fixed intervals through a third of a turn at a time in order to permit displaying three complete posters on its three sides.

Thus these two devices are heavily restricted with regard to the number of displayable posters, which is greatly disadvantageous compared with for instance other advertising media.

SUMMARY OF THE INVENTION

The primary object of the invention therefore is to provide an apparatus of the type mentioned for programmed display of a considerably greater number of, say up to a number of ten to twelve and possibly even more, said apparatus being in spite of this possibility of a simple and reliable construction, thus requiring but a minimum of maintenance.

This primary object is accomplished by the present invention in that the apparatus comprises a plurality of units arranged in a stand in spaced apart relationship and each having a plurality of frames which are disposed to pivot about a common axis and each have two opposite sides, one side of a frame turned towards the viewer cooperating with the other side of a second frame turned towards the viewer to form part of a display surface for a poster and the remainder of the display surface being formed by corresponding cooperating sides of the frames of the other units which are turned towards the viewer, and an operating mechanism for simultaneously turning at fixed intervals one of the frames of each unit which are turned towards the viewer through substantially 180° to cause said one frame to take the position of the other frame turned towards the viewer, said last-mentioned frame being caused by the action of the frame turning through substantially 180° to turn through a determined angle about the common axis and to turn the leading frames as seen in the direction of turning through an equally large angle, whereby the foremost frame as viewed in the direction of turning is caused to take the earlier position of the frame turning through substantially 180° and to have its side facing the viewer cooperate with the other side of the frame swung through substantially 180° to form part of another display surface for another poster and so on so that all posters are sequentially displayed a repeated number of times.

BRIEF DESCRIPTION OF THE DRAWINGS

The foregoing and additional objects, features and advantages of the invention will be apparent to those skilled in the art from the following detailed description of a preferred embodiment, taken with the accompanying drawings, in which.

DESCRIPTION OF A PREFERRED EMBODIMENT

Figure 3:
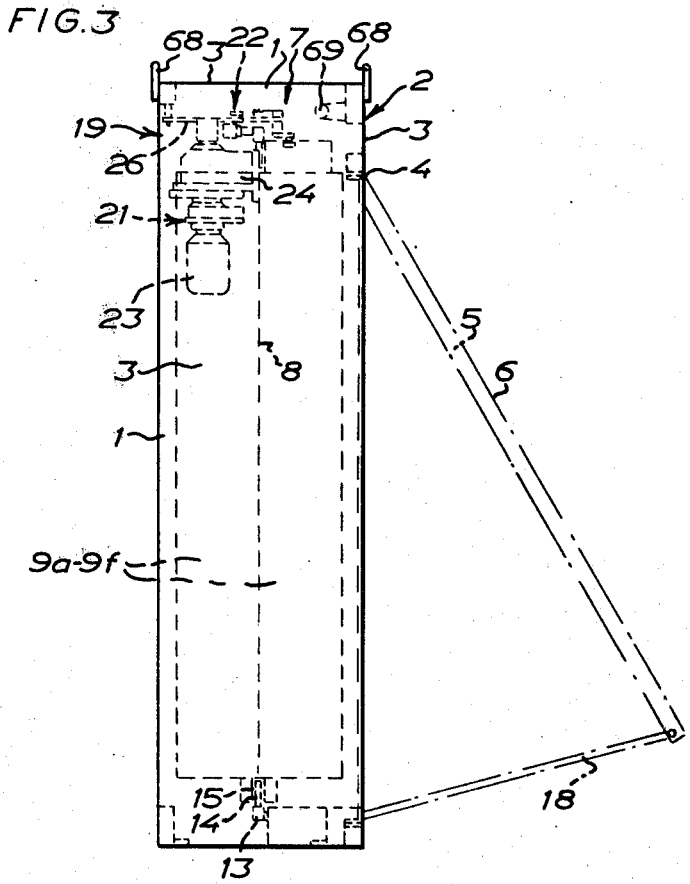

The apparatus according to the invention illustrated in the accompanying drawings has a stand 2 of parallelepipedical shape, which has been welded together from metal profiles 1. The width or length of the stand amounts to about 3.5 meters, its height to about 2.5 meters and its depth to about 0.7 meters. The stand 2 is encapsulated on all sides, except that facing the viewer, by means of cover sheets 3 mounted on the metal profiles. On the side facing the viewer the stand has a frame 5 which is hinged (at 4) to the stand and carries a transparent pane 6 of glass, plexiglass or some other suitable material. Said frame 5 permits being swung outwardly in a manner illustrated in FIG. 3 for a purpose to be described in the following. The stand is adapted to be mounted on a suitable foundation (not shown) which can be several meters in height so that the advertisement display device according to the invention is readily seen. Alternatively, the stand can be erected and mounted on a low base or on a house wall or the like.

A plurality of mutually spaced apart parallel units 7 are mounted within the stand 2. In the present instance the units 7 are five in number. Each unit 7 has a plurality of frames *9a–9f* which are arranged to pivot about a common vertical axis 8 and which are in the shape of leaves and made from bent aluminium sheet metal. In the present instance said frames are six in number. The frames *9a–9f* are of a cross-sectional shape slightly converging towards the axis 8 (see FIG. 5) and have two opposite planar sides 10 and 11 which are elongated and have their long axes vertically directed, i.e. in parallel with the axis 8. Planar aluminium metal sheets 12 can be releasably mounted on the two opposite planar sides 10, 11 of the frames *9a–9f* by means of fasteners (not shown), and parts of different posters to be displayed by means of the apparatus are for instance adhesively fastened to said metal sheets for a purpose to be described in the following.

To gain access to the apparatus for mounting, removing and adhering posters to the metal sheets 12 the authorized personnel can swing the frame 5 outwardly together with the transparent pane 6 and secure said frame in outwardly swung position by means of a clasp 18 and enter the apparatus.

As already mentioned, the frames *9a–9f* are adapted for being swung about a common axis 8. To permit this the frames are mounted on upper and lower pins 14 by means of superimposed bearing bushes 15, said pins 14 being coaxial with the axis 8 and fixedly mounted on the stand 2 by mounting means 13. Each frame 9a–9f is connected to the associated upper and lower bearing bushes 15 by means of wings 16 protruding from said bushes.

In each unit 7 one side 10 of a frame 9a facing the viewer cooperates in the same unit with the other side of another frame 9b facing the viewer to form part of the display surface 17 for a poster adhered to the metal sheets 12 on said sides. It follows that the remainder of the display surface 17 is formed in the same way by the corresponding cooperating sides 10 and 11 of the frames 9a and 9b in the remaining units 7, which frames face the viewer.

The advertisement display apparatus also includes an operating mechanism generally designated 19, which at predetermined intervals, say 16 seconds, simultaneously turns one of the frames 9a facing the viewer in each unit 7 through substantially 180° to cause said frame to occupy the position of the other frame 9b facing the viewer, the last-mentioned frame being caused by the action of the turning frame 9a to turn through a definite angle $\alpha$, in the case illustrated including six frames 9a–9f about 36°, and itself to turn the leading frames 9c–9f as viewed in the direction of turning by the same amount, i.e. about 36°, whereby the foremost frame 9f as viewed in the direction of turning is caused to occupy the earlier position of the frame 9a turning through substantially 180° and to have its side 10, which faces a viewer, cooperate with the other side 11 of the frame 9a now swung to form part of another display surface 17 for another poster. The procedure is then repeated so that all posters, in the present instance six by number, are displayed sequentially a repeated and desired number of times.

The operating mechanism 19 broadly comprises a drive assembly 21 and a linkage 22 driven by said assembly and connected to the units 7.

Figure 1:
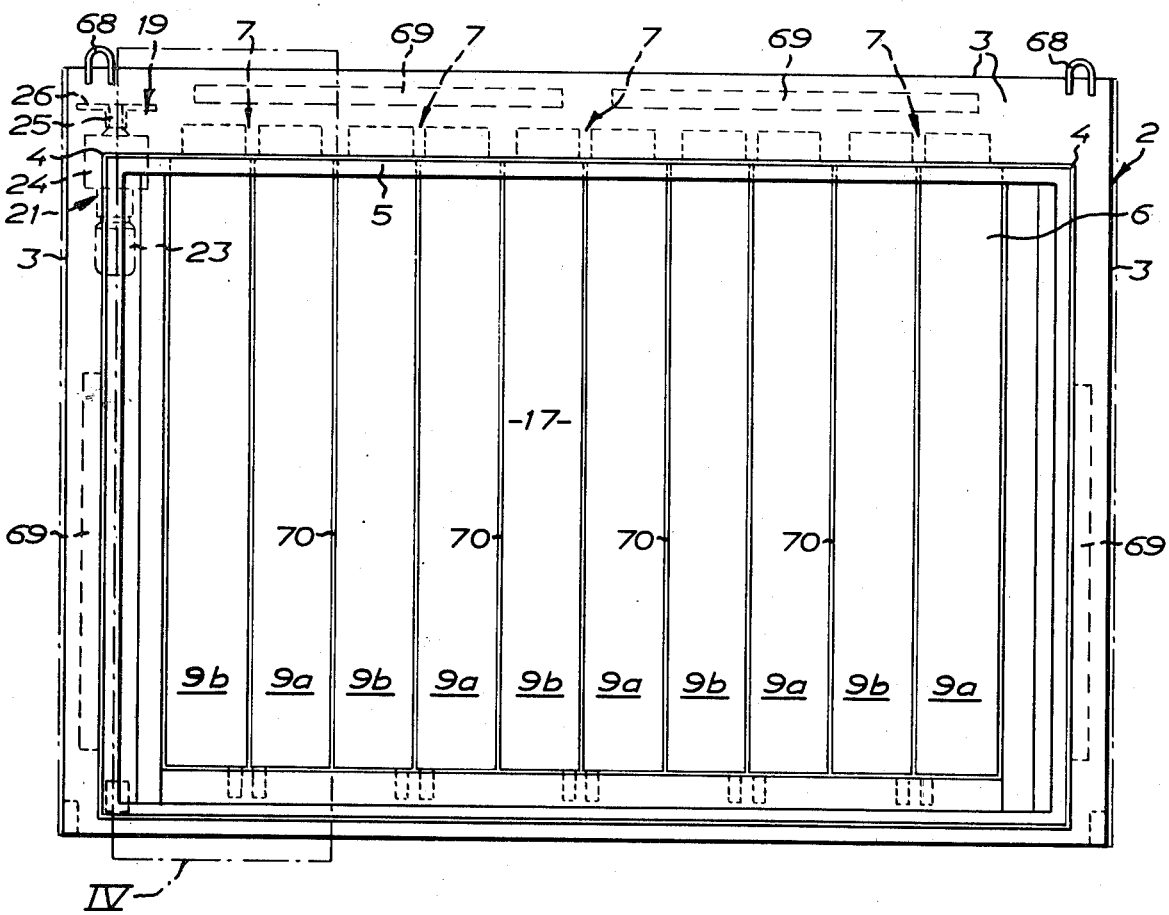
FIGS. 1, 2 and 3 are a front view, top plan view and side view, respectively, of the apparatus according to the invention, an upper cover sheet having been removed in FIG. 2 to show the underlying details.

The drive assembly 21 has an electric motor 23 mounted in a stand 20 at the upper left corner thereof as shown in FIG. 1. The electric motor 23 is supplied with current via a supply line (not shown) and is started and stopped by means of a switch (not shown) in the stand 2. The electric motor 23 has its output shaft directed vertically upwardly and a step down gearing 24 is connected to said output shaft, the transmission ratio between the motor 23 and the gearing 24 being such that a disk 26 secured to the output shaft 25 of the gearing 24 makes one full revolution per 16 seconds (about 3.75 rpm), i.e. by the poster display time here selected of 16 seconds. For increasing or reducing the speed of the disk 26 and thus the poster display time the electric motor 23 may be of variable speed, and/or the step down gearing 24 may be stepwise or infinitely adjustable.

The linkage 22 comprises a link 27 of flat iron or like material, which at one end 28 is pivoted to the disk 26 by a known type of joint 29 and has its other 30 pivoted by means of a known type of joint 31 to a pivot arm 32 between the ends 33 and 34 thereof.

At one end 33 the pivot arm 32 is mounted for swinging movement in the stand 2 above the unit 7 closest to the drive assembly 21 by means of a suitable bearing 35 to actuate the frames 9a–9f of said unit in a manner to be described in the following. The pivot arm 32 which like the link 27 may be of flat iron or like material is pivoted between the joint 31 for the link 27 and its other free end 34 to a connecting rod 37 by means of a known type of joint 36.

Like the link 27 and the pivot arm 32 the connecting rod 37 may be made of flat iron. Along its length said connecting rod is pivoted by joints 38, 39, 40 and 41 to four further pivot arms 46, 47, 48 and 49 pivoted in the stand 2 by means of suitable bearings 42, 43, 44, 45 and each associated with one of the other four units 7. All pivot arms 32 and 46–49 are synchronously pivotal by the action of the drive assembly 21, the link 27 and the connecting rod 37 for simultaneous actuation of the frames 9a–9f of the units 7. The pivot arms rest between their ends on cushions 50 which are arranged on the stand 2 and possibly lubricated to reduce the friction against the pivot arms.

Figure 4:
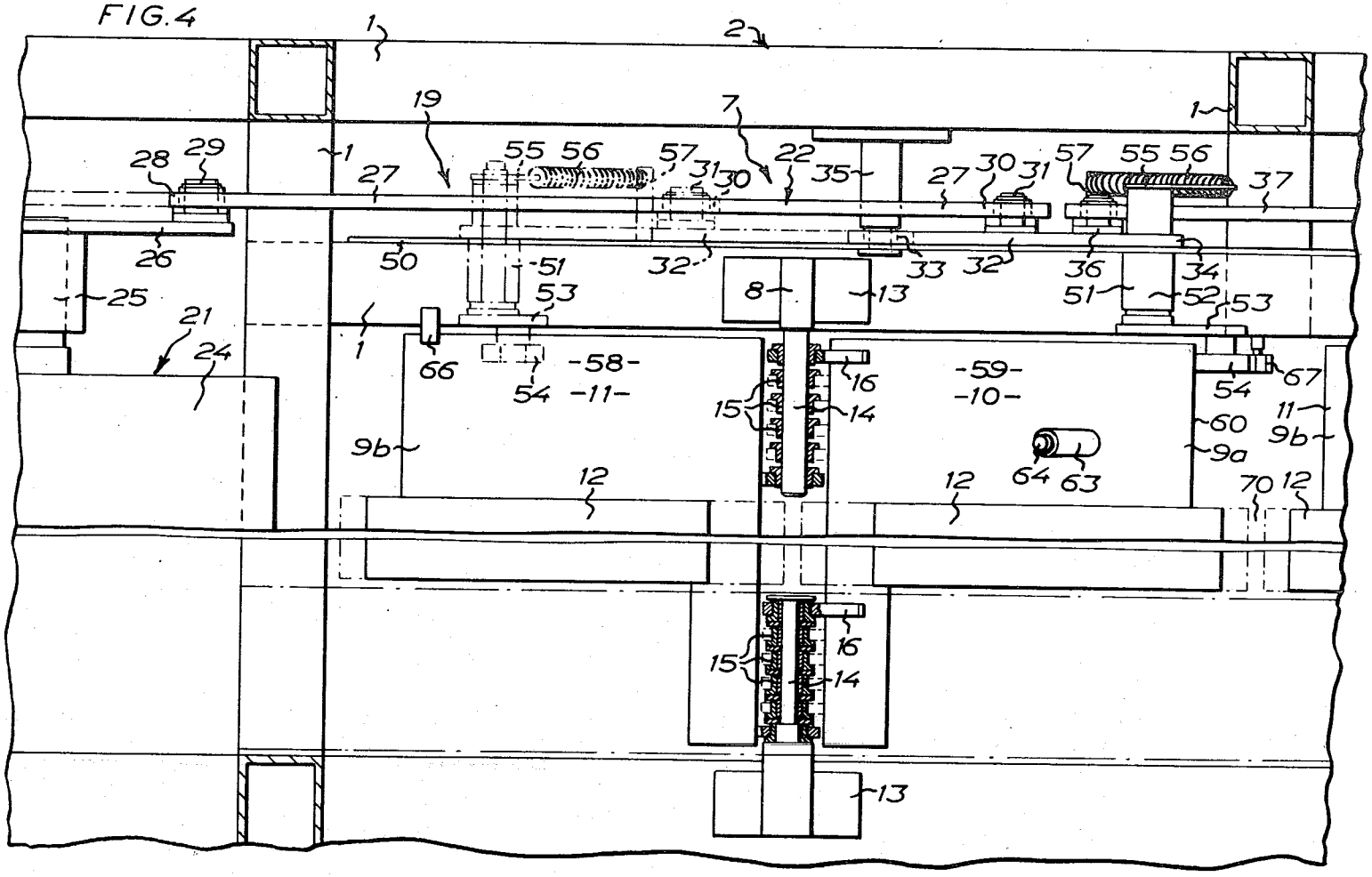
FIG. 4 shows the portion within the dash and dot frame IV in FIG. 1 on a larger scale, but longitudinally shortened.
Figure 5:
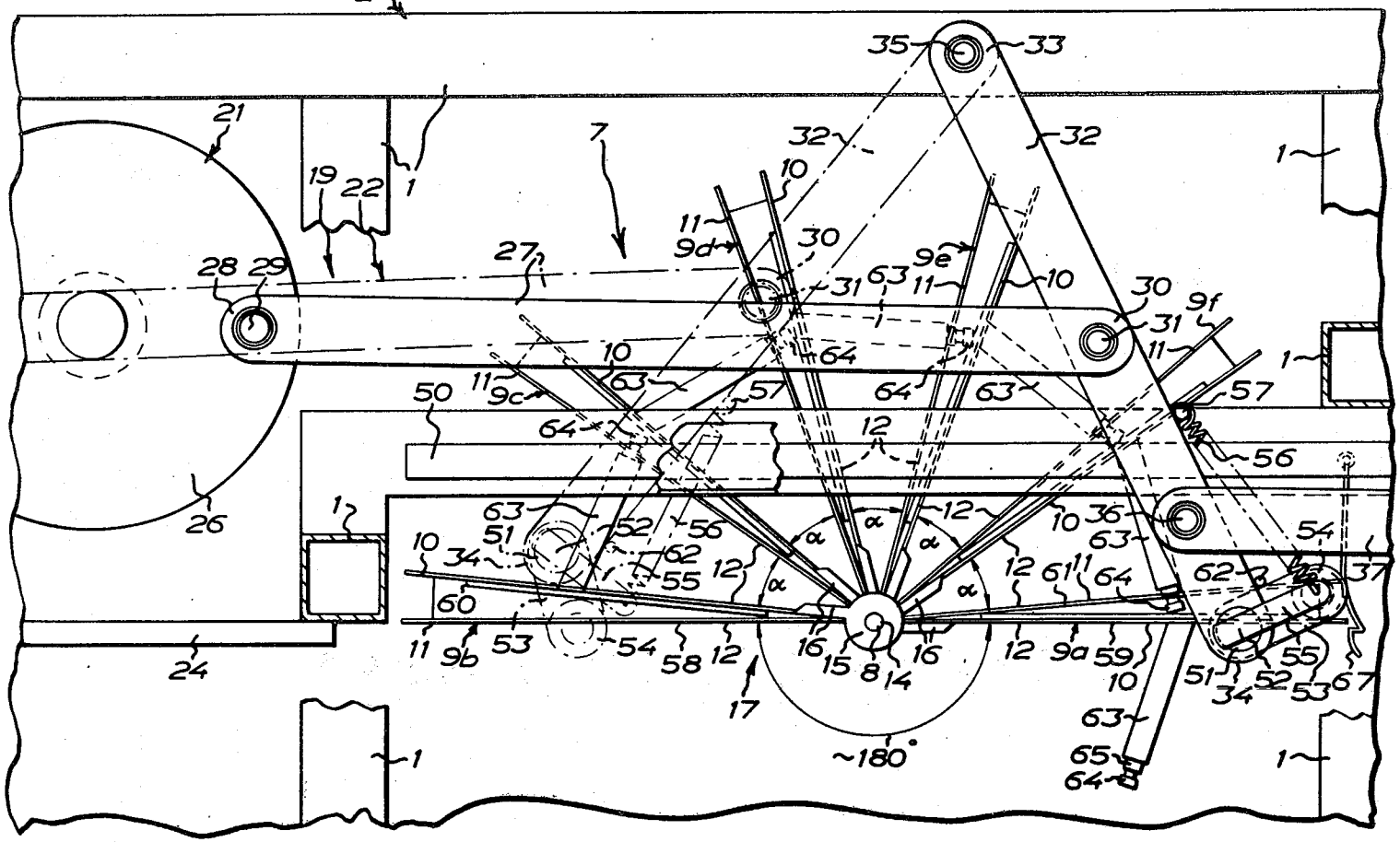
FIG. 5 shows the portion within the dash and dot frame V in FIG. 2, likewise on a larger scale.

At its free end 34, see FIGS. 4 and 5, each pivot arm 32 and 46–49 carries a bearing bush 51 for pivotally mounting a pin 52 which is fixedly connected at its lower end to a lever 53 making a right angle thereto. The lever 53 supports at its free end a freely rotatable roller 54 and is fixedly connected at its upper end to a further lever 55 which is parallel to said first lever 53 and is connected at its free end to one end of a tension spring 56 the other end of which is connected via a fastening lug 57 to the associated pivot arm 32 or 46–49. The spring 56 has for its object to load the roller 54 via the lever 55, the pin 52 and the lever 53 towards the frames 9a and 9b in a manner hereinafter described.

Figure 2:
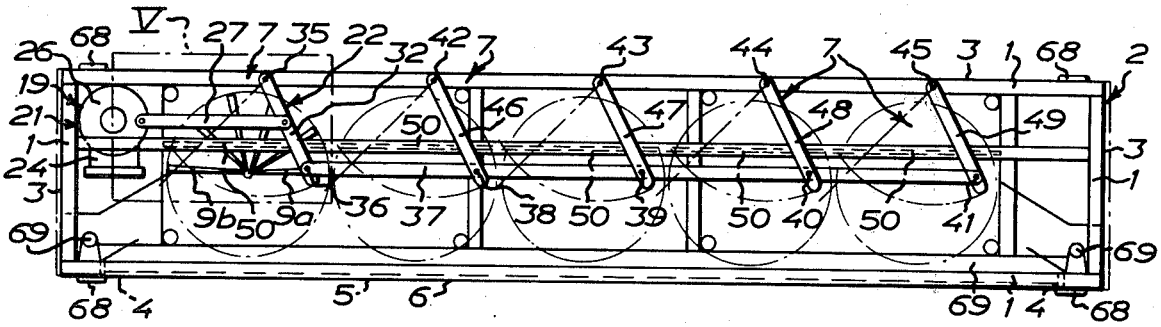

When the pivot arms 32 and 46–49 are swung in one direction (counterclockwise as viewed in FIG. 5) from the position shown by broken lines in FIGS. 2 and 5 the respective roller 54 rolls by the action of the spring 56 first on the outwardly facing side 58 of the frame 9b last turned through substantially 180°, then over to and on the outwardly facing side 59 of the frame 9a which is to be turned next through substantially 180°, and finally past the free long edge 60 of said frame 9a in order—still by the action of the spring 56—to be transferred onto the rearwardly facing side 61 of the frame 9a, the transfer of said roller 54 being limited by the lever 53 or 55 abutting against a stop pin 62 on the pivot arm 32.

When the pivot arms 32 and 46 are swung in the other direction (clockwise as viewed in FIG. 5) from the position shown by full lines in FIGS. 2, 4 and 5) the respective roller 54 thus rolls on the rearwardly facing side 61 of the frame 9a in order, when approaching and passing the common axis 8 to turn the frame 9a through substantially 180°, whereby the rearwardly facing side 61 will now be facing outwardly in the same way as the outwardly facing side 58 of the frame 9b which has now made room for the frame 9a.

Each frame 9a–9f carries a pipe 63 directed towards the leading frame as viewed in the direction of turning. Said pipe 63 is fixedly connected at one end to the associated frame for instance by welding and carries at the free end a buffer 64 which is adjustable in that it can be screwed into and out of a bush 65 or like member secured to the pipe 63. The pipe 63 with the buffer 64 forms on the one hand a spacer to maintain a predetermined center angle between the consecutive frames 9b–9f (see FIG. 5), said angle corresponding to the pivot angle $\alpha$ and amounting in the case illustrated to about 36° in the case of six frames 9a–9f, and on the other hand a thrust means serving to turn the other frames 9b–9f through the definite angle with the aid of the frame 9a being turned through substantially 180° so that the leading frame 9f as viewed in the direction of turning is caused to occupy the earlier position of the frame 9*a* turning through substantially 180°.

To prevent the frames 9*a*–9*f* from turning in the wrong direction, i.e. counterclockwise as viewed in FIG. 5, during or between the frame turning cycles a pawl 66 is provided on the stand 2 above the frame 9*b*, said pawl falling into latching position by gravity and when the next frame, i.e. frame 9*a*, has been turned said pawl is raised by said frame in order to fall again into latching position as soon as the frame has passed.

To prevent the frame 9*f* which is to occupy the earlier position of the frame 9*a* turned through substantially 180°, from turning past its display position, i.e. the position of the frame 9*a* in FIG. 5, a spring tongue is associated with the stand 2, said tongue having its free end bent so that it engages behind the frame. Said spring tongue can be moved aside by the action of the roller 54 when the latter is moved past the long edge 60.

Since the apparatus is relatively heavy lifting lugs 68 are provided at the four upper corners of the apparatus to permit moving the apparatus at the mounting thereof.

A plurality of suitably placed electric discharge lamps 69 serve to illuminate the posters in darkness or whenever necessary.

While the invention has been described with reference to the preferred embodiment described in the foregoing and shown in the accompanying drawings, those skilled in the art will realize that many modifications can be resorted to within the spirit and scope of the appendant claims.

What I claim and desire to secure by Letters Patent is:

1. An apparatus for the programmed display of advertising matter such as placards, posters and the like comprising a plurality of units (7) arranged in a stand (2) in spaced apart relationship and each having a plurality of frames (9*a*–9*f*) which are disposed to pivot about a common axis (8) and each have two opposite sides (10,11), one side (10) of a frame (9*a*) turned towards a viewer cooperating with the other side (11) of a second frame (9*b*) turned towards the viewer to form part of a display surface (17) for a poster and the remainder of the display surface being formed by corresponding cooperating sides (10, 11) of the frames (9*a*, 9*b*) of the other units (7) which are turned towards the viewer, and an operating mechanism (19) for simultaneously turning at fixed intervals one of the frames (9*a*) of each unit (7) which are turned towards the viewer through substantially 180° to cause said frame to take the position of the other frame (9*b*) turned towards the viewer, said last-mentioned frame being caused by the action of the frame turning through substantially 180° to turn through a determined angle (a) about the common axis and to turn the leading frames (9*c*–9*f*) as seen in the direction of turning through an equally large angle, whereby the foremost frame (9*f*) as viewed in the direction of turning is caused to take the earlier position of the frame (9*a*) turning through substantially 180° and to have its side (10) facing the viewer cooperate with the other side (11) of the frame swung through substantially 180° to form part of another display surface (17) for another poster and so on so that all posters are sequentially displayed a repeated number of times, wherein the operating mechanism (19) comprises a drive assembly (21) and a linkage (22) driven by said assembly and connected to said units (7), wherein the linkage (22) comprises a link (27) pivoted at one end (28) to said disk (26) and being pivoted at its other end (30) to a pivot arm (32) between the ends (33,34) thereof, said pivot arm being pivoted with its one end (33) in said stand (2) above the unit (7) closest to the drive assembly (21) to actuate the frames (9*a*–9*f*) of said unit and being pivoted between the joint connection (29) for said link (27) and its free end (34) to a connecting rod (37) which is hinged to further pivot arms (46–49) pivotally mounted in the stand (2) and each associated with the other units (7), said further pivot arms being pivotal in synchronism with said first pivot arm (32) for simultaneous actuation of the frames (9*a*–9*f*) of all units, the pivot arms (32, 46–49) carrying at their free ends (34) a lever (53) which can be swung against the action of a spring (56) connected to a lug (57) on said pivot arm (32) and to said lever (53) through a pin (52) extending through said free end (34) and which supports at its free end a freely rotatable roller (54) which when the pivot arms (32, 46–49) are swung in one direction first rolls on the outwardly facing side (58) of the frame (9*b*) last turned through substantially 180°, then on the outwardly facing side (59) of the frame (9*a*) which is to be turned next through substantially 180°, and finally past the free long edge (60) of said frame to be transferred by the action of the spring (56) actuating the lever onto the rearwardly facing said (61) of the frame, and when the pivot arms (32, 46–49) are swung in the other direction rolls on the rearwardly facing side (61) and turns the frame (9*a*) through substantially 180° so that the rearwardly facing side will be facing outwardly, whereupon the procedure is repeated.

2. An apparatus as claimed in claim 1, wherein said units (7) mounted in said stand (2) are arranged closely together defining gaps (7) between the frames (9*a*, 9*b*) of the units forming the total display surface (17) that are minimal.

3. An apparatus as claimed in claim 1, wherein the frames (9*a*–9*f*) in each unit (7) are formed from bent sheet metal and the two opposite sides (10,11) of each frame are elongated and oriented with the long axis vertically directed.

4. An apparatus as claimed in claim 1 wherein the two opposite sides (10,11) of each frame (9*a*–9*f*) are formed of removably securable planar sheets (12) and on which parts of the different posters are fixed.

5. An apparatus as claimed in claim 1 wherein the frames (9*a*–9*f*) of each unit (7) are pivoted by means of superimposed bearing bushes (15) on upper and lower pins (14) coaxial with the common axis (8).

6. An apparatus as claimed in claim 1, wherein the stand (2) is composed of metal profiles (1) and has substantially parallelepipedical shape, the stand being encapsulated on all sides, except that facing the viewer, preferably by means of cover sheets (3) and having on the side facing the viewer a transparent pane (6) of glass, plexiglass or like material, which can be opened.

7. An apparatus as claimed in claim 1, wherein the drive assembly (21) comprises an electric motor (23) fixedly disposed in the stand (2), and a step down gearing (24) connected to the output shaft (25) of said electric motor and having a disk (26) fixed to the output shaft (25) of said gearing.

8. An apparatus as claimed in claim 1, wherein releasable fastening means (66, 67) connected to the stand (2) are arranged to prevent the frames (9*a*–9*f*) from turning in the wrong direction and the frame (9*f*) which is to occupy the position of the frame turned through substantially 180° from turning past its display position.

9. An apparatus as claimed in claim 1 wherein each frame (9*a*–9*f*) carries means (63) directed towards the leading frame as viewed in the direction of turning and forming on the one hand a spacer to maintain a predetermined center angle ($\alpha$) between the consecutive frames whose sides (10, 11) momentarily do not form the display surface (17) facing the viewer, and on the other hand a thrust means serving to turn the other frames (*9b–9f*) through the definite angle ($\alpha$) with the aid of the frame (*9a*) which is being turned through substantially 180° so that the foremost frame (*9f*) as viewed in the direction of turning is caused to occupy the earlier position of the frame (*9a*) turned through substantially 180°.

* * * * *